US007733242B2

(12) United States Patent
Bertels et al.

(10) Patent No.: US 7,733,242 B2
(45) Date of Patent: Jun. 8, 2010

(54) SYSTEM, METHOD AND APPARATUS FOR MANUAL CONTROL OF A TRAFFIC LIGHT

(75) Inventors: Paul Bertels, Largo, FL (US); Himanshu Patni, Clearwater, FL (US)

(73) Assignee: City of Clearwater, Clearwater, FL (US)

( * ) Notice: Subject to any disclaimer, the term of this patent is extended or adjusted under 35 U.S.C. 154(b) by 315 days.

(21) Appl. No.: 12/056,512

(22) Filed: Mar. 27, 2008

(65) Prior Publication Data

US 2009/0243885 A1 Oct. 1, 2009

(51) Int. Cl.
*G08G 1/07* (2006.01)
*G08G 1/095* (2006.01)

(52) U.S. Cl. ..... 340/926; 340/906; 340/907; 340/909; 340/931

(58) Field of Classification Search ..... 340/926, 340/930, 931
See application file for complete search history.

(56) References Cited

U.S. PATENT DOCUMENTS 2,829,362 A 4/1958 Terrill
3,119,093 A 1/1964 Willyard
4,135,144 A 1/1979 Elmasian
5,073,866 A 12/1991 Daeges
6,522,263 B2 2/2003 Jones
2004/0051651 A1 3/2004 Carter
2007/0115139 A1 5/2007 Witte et al.

*Primary Examiner*—Donnie L Crosland
(74) *Attorney, Agent, or Firm*—Larson & Larson, P.A.; Frank Liebenow

(57) ABSTRACT

An application for a traffic control system includes an enclosure for containing the traffic control system that has an access door with a lock for controlling access to the enclosure through the access door. The traffic control system has an automatic mode of operation and a manual mode of operation, whereas the traffic control system automatically transitions a state of a plurality of traffic lights when in the automatic mode of operation and cycles the state of the plurality of traffic lights in response to a change signal when in the manual mode of operation. An automatic mode activation switch is housed within the enclosure. Activation of the automatic mode activation switch changes the state of the traffic control system from the automatic mode of operation into the manual mode of operation. A watchdog timer is coupled to the traffic control system, The watchdog timer is reset when the automatic mode activation switch is operated and in response to the change signal. If the watchdog timer expires, the traffic control system switches to the automatic mode of operation.

15 Claims, 7 Drawing Sheets

SYSTEM, METHOD AND APPARATUS FOR MANUAL CONTROL OF A TRAFFIC LIGHT

FIELD OF THE INVENTION

This invention relates to the field of techniques and systems for controlling traffic and more particularly to a system for switching an automatic traffic control system to a manual mode and automatically switching back to an automatic mode after a period of inactivity.

BACKGROUND OF THE INVENTION

We see traffic control systems at many road intersections. In the United States, the acceptable traffic control system is a traffic light system for each intersection direction having a red, yellow and green indicator (light) The green indicates the traffic in that direction can proceed through the intersection. The yellow indicates that the traffic light is transitioning between green and red and traffic should prepare to stop. The red indicates the traffic in that direction should stop. In some systems, multiple sets of lights are configured in a given direction with some dedicated to traffic in turn lanes.

The traffic control system has timers that are programmed to control the duration of each signal depending upon the average traffic levels and the amount of time required to move across an intersection, etc. Some traffic control systems are coupled to one or more nearby traffic control systems to provide synchronization between multiple traffic control systems to aid in the efficient flow of traffic. Additionally, some traffic control systems are capable of being centrally controlled by an operator, whereby an operator is provided with tools to change timing, etc., to improve traffic flow.

During unusual traffic patterns such as when an event begins or is finished, often the traffic control system is manually operated by a police officer. In such, the police officer access the control box (unlocks and opens a door) of the traffic control system and switches the traffic control system from automatic to manual. From there, the police officer changes the state of the traffic control system by operating a manual control. When finished, the police officer switches the traffic control system back into automatic mode and closes/locks the traffic control system door. Unfortunately, there are circumstances where the police officer must leave in an emergency. In such, if the police officer forgets to switch the traffic control system back to automatic mode, the traffic control system will remain green in one direction and red in the other direction, causing a major traffic problem.

What is needed is a traffic control system that will revert to an automatic mode when left unattended in a manual mode.

SUMMARY OF THE INVENTION

In one embodiment, a traffic control system is disclosed including an enclosure for containing the traffic control system that has an access door with a lock for controlling access to the enclosure through the access door. The traffic control system has an automatic mode of operation and a manual mode of operation, whereas the traffic control system automatically transitions a state of a plurality of traffic lights when in the automatic mode of operation and cycles the state of the plurality of traffic lights in response to a change signal when in the manual mode of operation. An automatic mode activation switch is housed within the enclosure. Activation of the automatic mode activation switch changes the state of the traffic control system from the automatic mode of operation into the manual mode of operation. A watchdog timer is coupled to the traffic control system, The watchdog timer is reset when the automatic mode activation switch is operated and in response to the change signal. If the watchdog timer expires, the traffic control system switches to the automatic mode of operation.

In another embodiment, a method of controlling traffic is disclosed including unlocking an enclosure of a traffic control system and changing an operating mode of the traffic control system from an automatic mode of operation to a manual mode of operation. The changing of the operating mode of the traffic control system also starts a watchdog timer. A traffic control device connected to the traffic control system is operated to cycle a plurality of traffic lights, said operation of the traffic control device also resets the watchdog timer. If the watchdog timer expires, the mode of operation of the traffic control system is changed from the manual mode of operation back into the automatic mode of operation.

In another embodiment, a traffic control system is disclosed including an enclosure for containing the traffic control system with an access door and a lock controlling access to the enclosure through the access door. The traffic control system has an automatic mode of operation and a manual mode of operation, whereas the traffic control system automatically cycles the state of traffic lights when in the automatic mode of operation and cycles the state of the traffic lights in response to a change signal when in the manual mode of operation. An activation device within the enclosure changes the traffic control system into the manual mode. A watchdog timer is reset both when the automatic mode activation switch is operated and in response to the change signal. A wireless transmitter transmits a wireless change signal in response to pressing of a control on the wireless transmitter. A wireless receiver coupled to the traffic control system receives the wireless change signal and, in response, sends the change signal to the traffic control system and resets the watchdog timer. If the watchdog timer expires, the traffic control system switches back to the automatic mode of operation.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
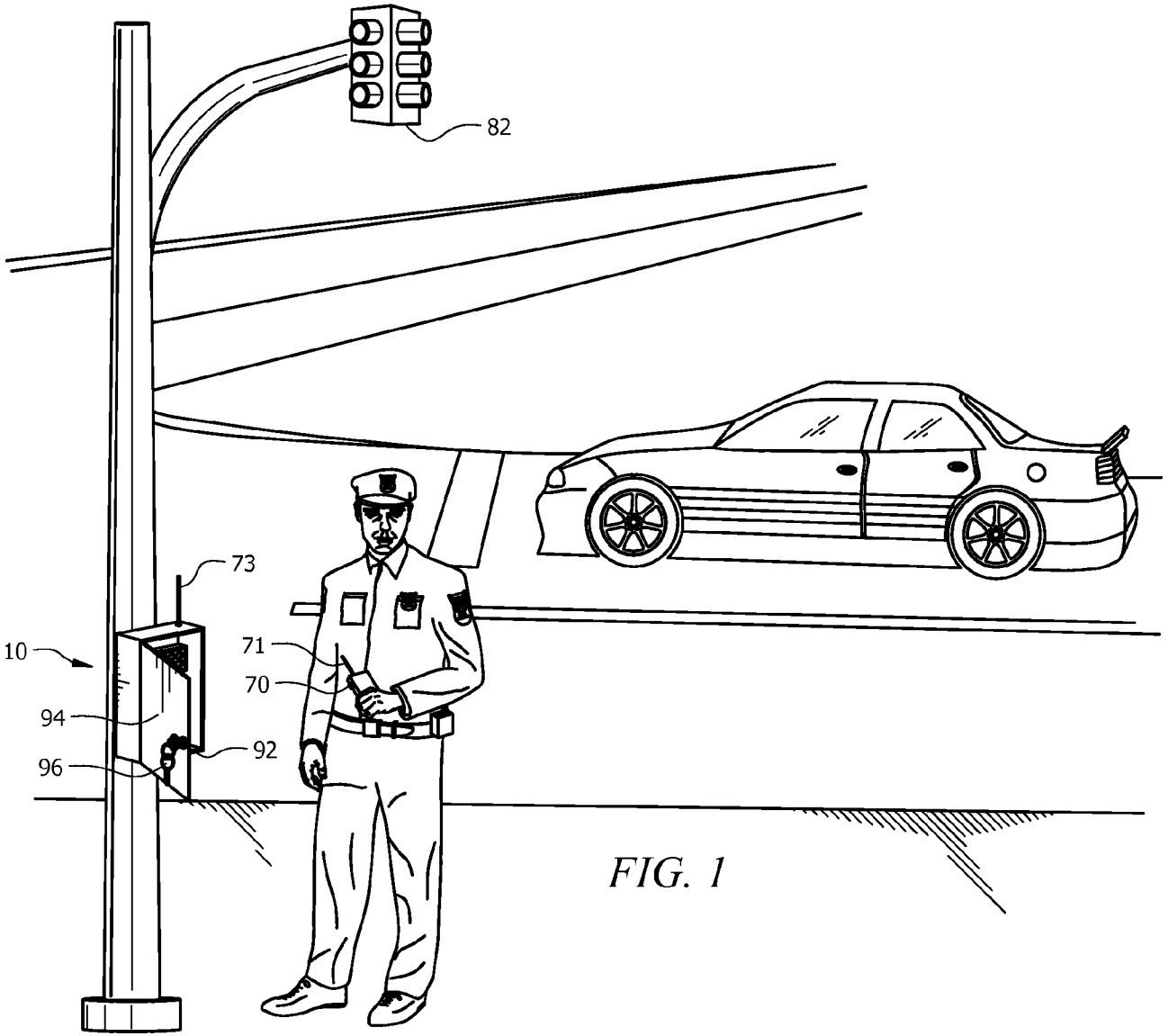
FIG. 1 illustrates a perspective view of a system of a first embodiment of the present invention.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a perspective view of a system of a first embodiment of the present invention is shown. In this example, a police officer holds a wireless remote control 70 for a traffic control system 10. Although the present invention works equally as well with a traffic control system that has a tethered (wired) hand control, the present invention is intended for traffic control systems that have a wireless hand control 70 (as shown). The main reason for such is that since the police officer may be operating the traffic control system 10 from a distance, perhaps across the street, if the officer should receive an emergency call, the officer may forget or explicitly decide to abandon the traffic control system 10, leaving it in its manual mode until returning later. By doing such, major traffic problems will arise.

FIG. 1 shows an exemplary traffic control system with multi-colored traffic control lights 82, the traffic control box 10 with an access door 94 that has a lock 92 shown with keys 96 present. In this example, an antenna 73 provides for receipt of wireless manual control signals from the antenna 71 of the hand held traffic control transmitter 70. The locking access door 94 provides a level of security so an unauthorized person would have difficulty accessing the traffic control system 10.

Figure 2:
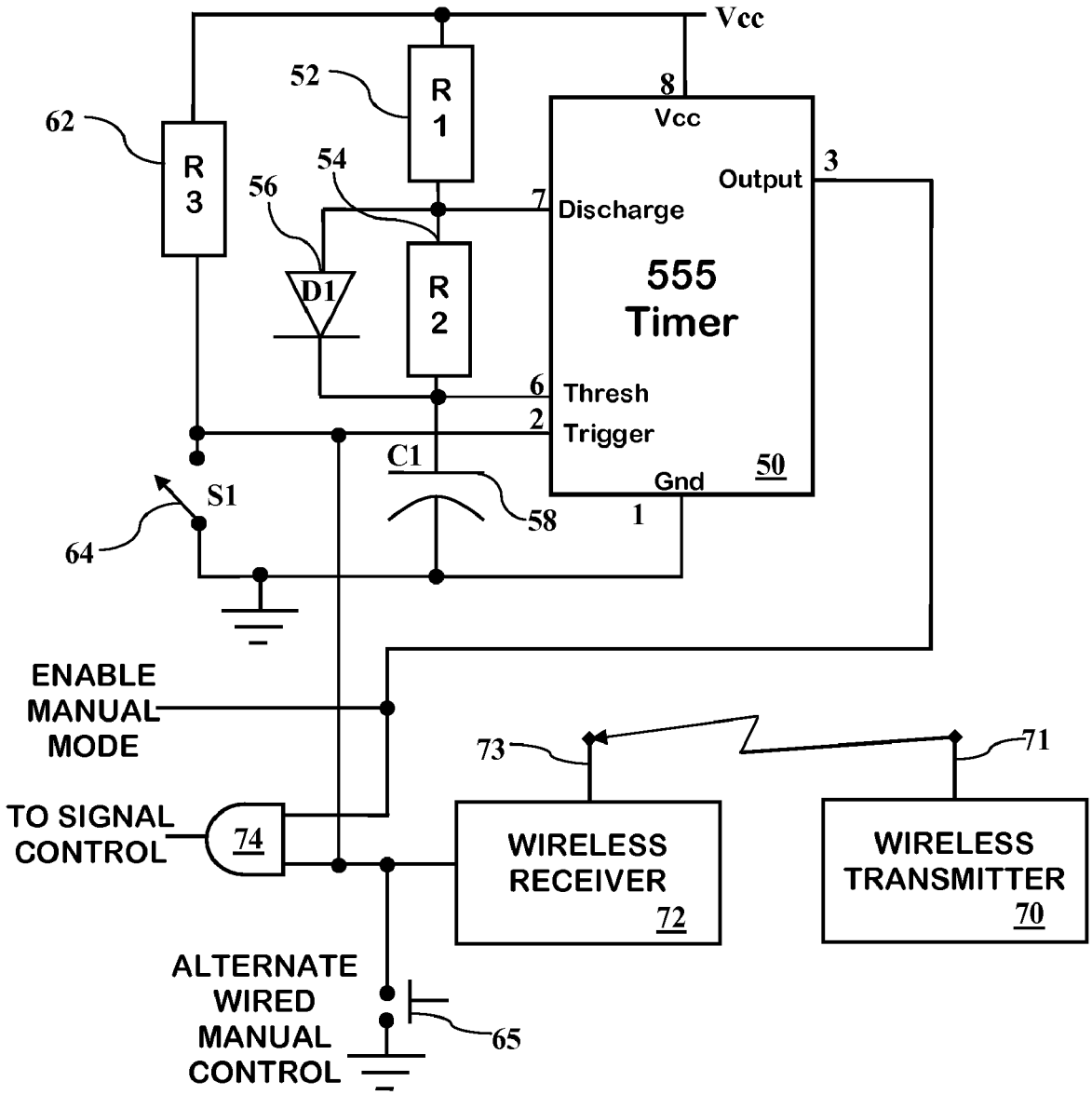
FIG. 2 illustrates a schematic view of a system of the present invention.
Figure 2A:
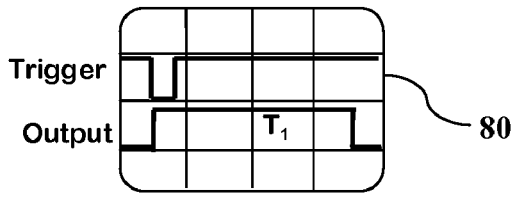
FIG. 2A illustrates a schematic view of a timing diagram of the system of the present invention.

Referring to FIG. 2, a schematic view of a system of the present invention is shown. In this embodiment, an industry standard 555 timer 50 is employed to generate a watchdog timer period ($T_1$). The circuit of FIG. 2 is an astable multivibrator whose watch dog timer period is determined by R1 52, R2 54 and C1 58. The cycle begins when the manual mode push button switch 64 is depressed. This action triggers the 555 timer 50 (pin 2) causing the output (pin 3) to go high as shown in the timing diagram FIG. 2A. The output of the 555 timer 50 is an input to an AND gate 74. When the output of the 555 timer is high, the AND gate 74 permits traffic control signals from the wireless receiver 72 to pass to the traffic control system. Additionally, it enables manual mode operation of the traffic control system.

Now, R1 52 charges C1 58 through diode D1 56 until the voltage across C1 58 reaches a threshold at pin 6 of the 555 timer 50. At that point, the output of the 555 timer 50 goes low, thereby disabling the manual mode and preventing further wireless control signals from passing to the signal control. The watchdog time period ($T_1$) is determined by the values of R2 54 and C1 58. The time period ($T_1$) is approximately 0.69(R1+R2)*C1. The trigger input and output signal of the 555 timer 50 is shown on oscilloscope screen 80 of FIG. 2A. For example, using a 1.8M resistor for R1 52, a 15K resistor for R2 54 and a 1000 uf capacitor for C1 56 yields a time period ($T_1$) of approximately 20 minutes.

If a wireless signal is received from the antenna 71 of the wireless transmitter 70 at the antenna 73 of the wireless receiver 72 before the watchdog timer expires, the wireless signal resets the timing capacitor C1 58, thereby restarting the watchdog timer period. In this way, as long as a signal is received periodically (e.g., the police officer is actively controlling the traffic control system 10), the watchdog timer is repeatedly reset and doesn't expire.

Alternately, the alternate tethered signal change control includes a wired pushbutton switch 65 used to control the cycling of the traffic lights and to reset the watchdog timer.

A pull-up resistor R3 62 biases the trigger to a positive voltage until the wireless signal (or tethered signal) is received or until the push-button switch 64 is pressed.

Figure 3:
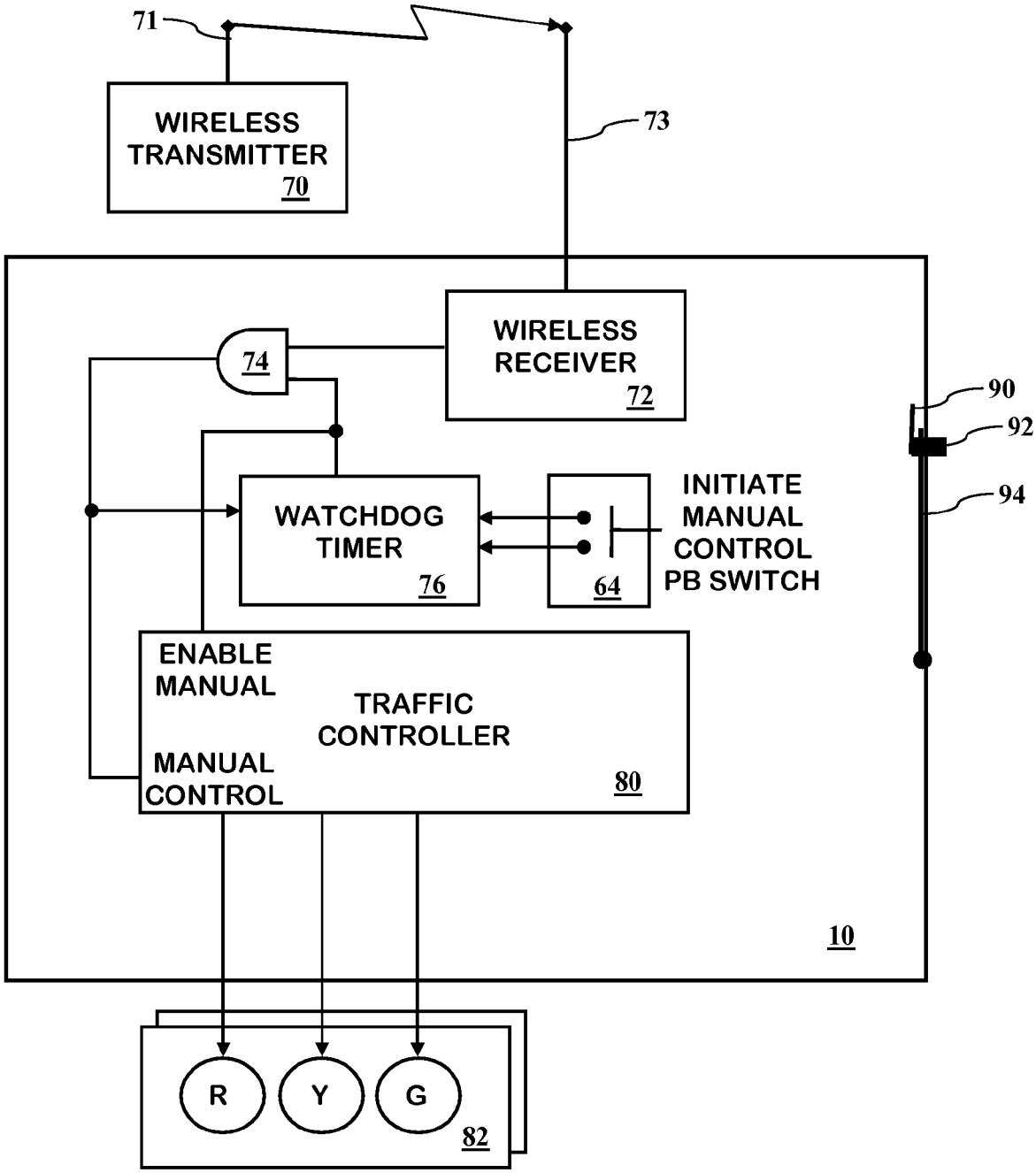
FIG. 3 illustrates a block diagram of the present invention.

Referring to FIG. 3, a block diagram of the present invention is shown. In this embodiment, the traffic control system 10 has an access door 94 that is locked by a lock 92 that has a lock arm 90 that helps prevent the access door 94 from being opened without a key. Any type of lock known in the industry is anticipated. Once the access door 94 is open, the user (police officer) has access to the "Initiate Manual Control" push button switch 64. Once pressed, the push button switch 64 signals the watch dog timer to start timing and to output a signal to enable manual control of the traffic controller 80.

While in manual mode, the user periodically sends signals to control the traffic patterns. In this example, a wireless system is used, although a wired (tethered) system works equally as well. The wireless signal is sent from a hand-held wireless transmitter 70 with antenna 71 to a wireless receiver 72 that also has an antenna 73. The change signal from the wireless receiver 72 does two things; it resets the watchdog timer 76 and, passing through the AND gate 74, it manually controls the traffic controller 80, changing the outputs of the traffic controller 80 and, hence, the lighted patterns on the traffic light 82.

This embodiment operates slightly differently from that of FIG. 2. That is, once the watchdog timer expires and the output of the watchdog timer goes low, all signals from the wireless receiver 72 are stopped by the AND gate 74 and, therefore, do not reset the watchdog timer after it expires. In this embodiment, once the watchdog timer expires, the user needs to press the "Initiate Manual Control" push button 64 to re-enter manual mode.

Figure 4:
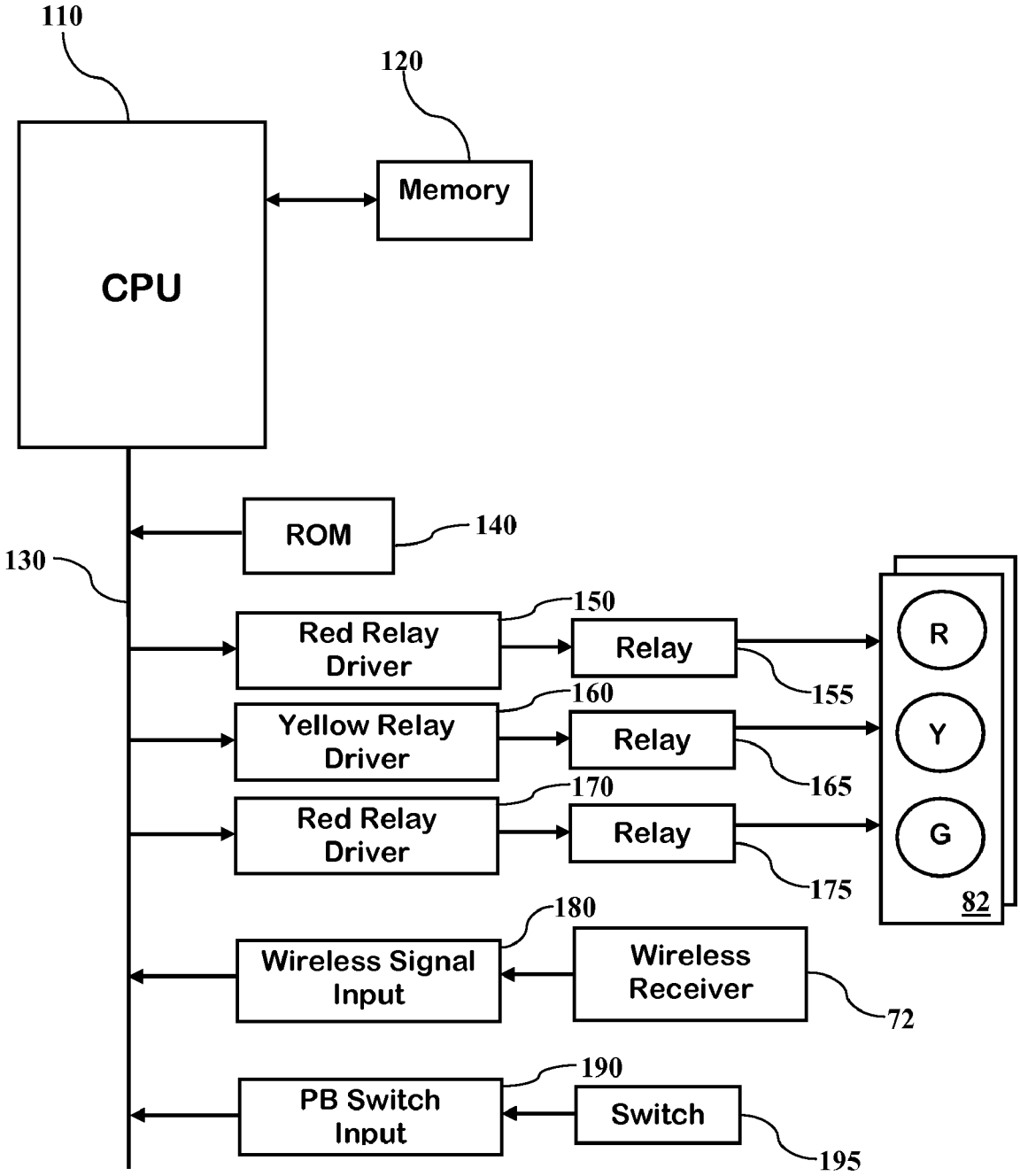
FIG. 4 illustrates a block diagram of a computer system of an alternate embodiment of the present invention.

Referring to FIG. 4, a block diagram of a computer system of an alternate embodiment of the present invention is shown. In this embodiment, the traffic signals 82 are controlled by a computer system. The computer system has a processor (CPU, controller, etc.) 110 with internal or external memory 120 and a system bus 130 for connecting stored program memory 140 and other peripherals. The processor 110 can be any processor or a group of processors, for example an Intel Pentium-4® CPU or the like. The memory 120 is connected to the processor and can be any memory suitable for connection with the selected processor 210, such as SRAM, DRAM, SDRAM, RDRAM, DDR, DDR-2, etc. Firmware is stored in firmware storage 140 that is connected to the processor 110 and may include initialization software. The firmware storage 140 is any known persistent storage such as ROM, PROM, EPROM, EEPROM, FLASH, FERAM, etc.

Connected to the bus 130 are relay drivers 150/160/170 for controlling relays 155/165/175 that are used to illuminate the red, yellow and green lights of the traffic signal 82. This is an example of one way for a computer system to control lights and other ways known in the industry are equally suited for the present invention including direct drive with open collector (open drain) transistors, etc.

In this embodiment, the wireless receiver 72 is connected to an input bit 180 for signaling the firmware running on the processor 110 when a wireless signal is received. Likewise, the push button switch 195 is connected to another input 190 for signaling the firmware running on the processor 110 when the push button is pressed. Many ways are known in the industry to communicate external signals to a processor, all of which are anticipated and included here within. Likewise, other inputs and outputs are anticipated such as diagnostic control signals, etc.

Figure 5:
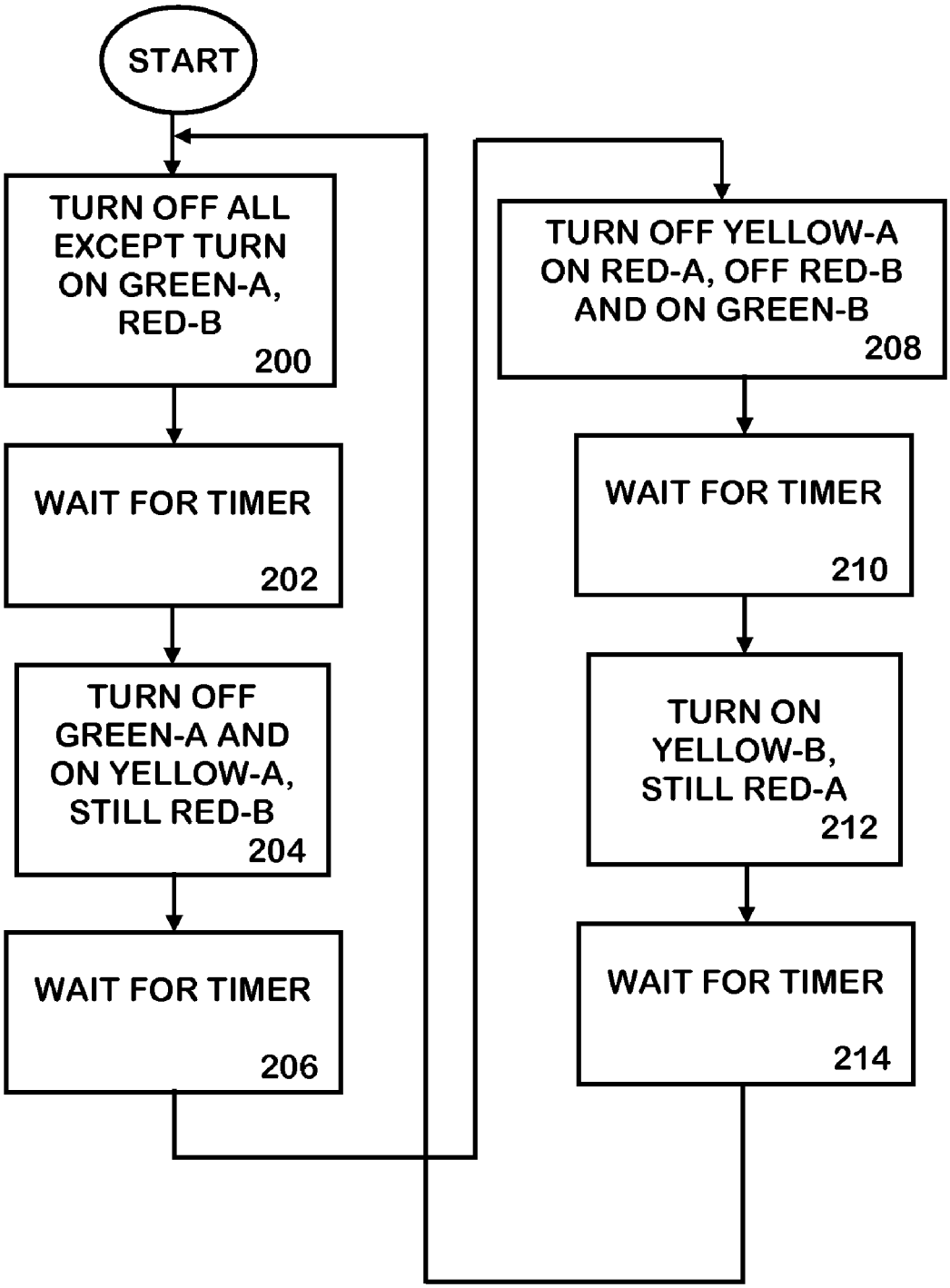
Fig. 5 (PRIOR ART)
FIG. 5 illustrates a flow chart of the prior art.

Referring to FIG. 5, a flow chart of the prior art is shown. A typical traffic control system of the prior art using a computer system similar to FIG. 4 (without the wireless control) would have an initial state having traffic flowing in one direction (Direction-A) and stopped in the other direction (Direction-B). The system begins with turning on green in Direction-A and red in Direction-B 200. The system then waits for the amount of time allowed for Direction-A 202 then the system turns off the green and turns on the yellow signal for Direction-A 204. After a short period of time determined by the timer 206, the system turns off the yellow in Direction-A, turns on the red in Direction-A, turns off the red in Direction-B and turns on the green in Direction-B 208. Next, after the amount of time allotted to Direction-B expires 210, the system turns off the green in Direction-B and turns on the yellow in Direction-B 212. After another timer 214, the sequence repeats.

In some known traffic control systems, the sequencing of lights differs from the examples presented. The present invention is for the automatic and manual operation of a traffic control system and operates with any sequencing of traffic lights known or unknown, including any red clearances as well as yellow clearances and systems that employ different configurations of light such as systems with only red and green lights. Additionally, some systems use sequences that permit the operation of more than one light at a time such as illuminating red and yellow concurrently. All such systems are incorporated in the present invention.

Figure 6:
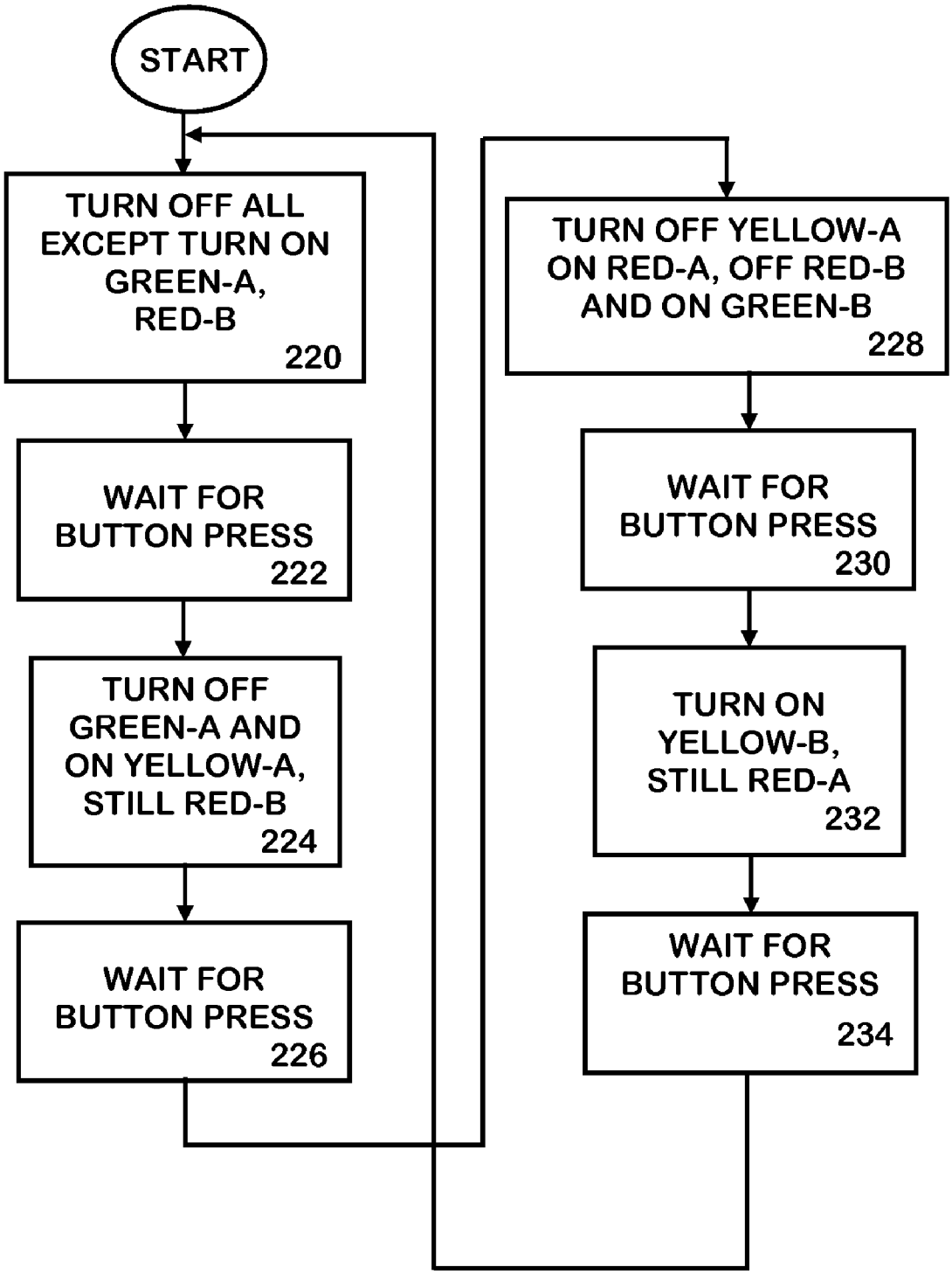
FIG. 6 illustrates a first flow chart of the alternate embodiment of the present invention.

Referring to FIG. 6, a flow chart of the alternate embodiment of the present invention is shown. A typical traffic control system using a computer system similar to FIG. 4 (without the wireless control) would have an initial state having traffic flowing in one direction (Direction-A) and stopped in the other direction (Direction-B). The system begins with turning off all signal lights except turning on green in Direction-A and red in Direction-B 220. The system then waits for a manual change signal 222 then the system turns off the green and turns on the yellow signal for Direction-A 224. The system then waits for a manual change signal 226, then the system turns off the yellow in Direction-A, turns on the red in Direction-A, turns off the red in Direction-B and turns on the green in Direction-B 228. Next, after the system then waits for a manual change signal 230, the system turns of the green in Direction-B and turns on the yellow in Direction-B 232. After waiting for a manual change signal 234, the sequence repeats. This is a typical flow and many traffic systems are known with different flows accommodating left-turn arrows, right-turn arrows, multiple directions of traffic flow, etc. Furthermore, other traffic control systems automatically time the caution period (yellow) even during manual control. All such timings and features are included in the present invention.

Figure 7:
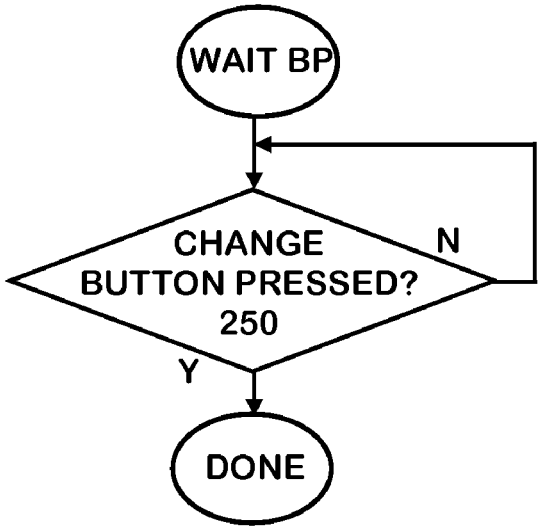
Fig. 7 (PRIOR ART)
FIG. 7 illustrates a second flow chart of the prior art.

Referring to FIG. 7, a second flow chart of the prior art is shown. In the prior art, the wait for button press operation was exactly that, the software waited for a button press signal 250.

Figure 8:
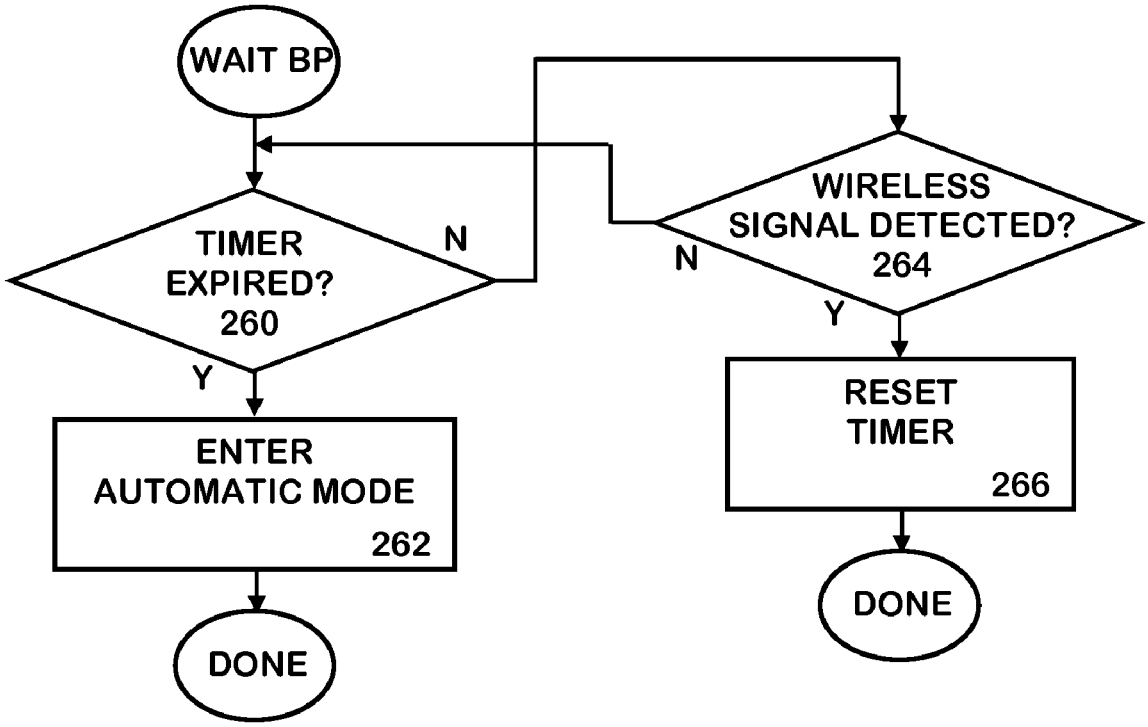
FIG. 8 illustrates a second flow chart of the alternate embodiment of the present invention.

Referring to FIG. 8, a second flow chart of the alternate embodiment of the present invention is shown. This flow is performed in place of the "waiting for button press 222/226/230/234 of FIG. 6. In this example, waiting for the button press includes checking to see if the watchdog timer has expired 260. If it has, the automatic mode is entered 262. If it has not expired yet, a check is made to see if a wireless signal was received 264 signaling the traffic control system to change. If no wireless signal was received 264, the process is repeated until either the watchdog timer expires or a wireless signal is detected 264. If the wireless signal is received 264, the watchdog timer is reset 266 and waiting is done. In a non-wireless system (tethered control), the system checks for a button press of the tethered control device (not shown) instead of checking for a wireless signal 264.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A traffic control system comprising:

an enclosure for containing the traffic control system;

an access door on the enclosure;

a lock controlling access to the enclosure through the access door;

an automatic mode of operation and a manual mode of operation, whereas the traffic control system automatically transitions a state of a plurality of traffic lights when in the automatic mode of operation and cycles the state of the plurality of traffic lights in response to a change signal when in the manual mode of operation;

an automatic mode activation switch within the enclosure, activation of the automatic mode activation switch changing the state of the traffic control system from the automatic mode of operation into the manual mode of operation; and a watchdog timer operatively coupled to the traffic control system, the watchdog timer is reset when the automatic mode activation switch is operated; the watchdog timer is also reset in response to the change signal;

whereas upon expiration of the watchdog timer, the traffic control system switches to the automatic mode of operation.

2. The traffic control system of claim 1, wherein the change signal is from a wired control panel connected to the traffic control system.

3. The traffic control system of claim 1, wherein the change signal is from a wireless control, the wireless control transmits a wireless signal to a wireless receiver connected to the traffic control system and the wireless receiver generates the change signal to the traffic control system for sequencing the state of the plurality of traffic lights.

4. The traffic control system of claim 3, wherein the the watchdog timer is reset upon receipt of the wireless signal.

5. The traffic control system of claim 3, wherein the the watchdog timer is reset upon receipt of the wireless signal only if the watchdog timer has not expired.

6. A method of controlling traffic comprising:

unlocking an enclosure of a traffic control system;

changing an operating mode of the traffic control system from an automatic mode of operation to a manual mode of operation, the changing of the operating mode of the traffic control system also starting a watchdog timer;

operating a traffic control device connected to the traffic control system to cycle a plurality of traffic lights, said operation of the traffic control device also resetting the watchdog timer;

if the watchdog timer expires, changing the mode of operation of the traffic control system from the manual mode of operation back into the automatic mode of operation.

7. The method of claim 6, wherein the traffic control device is a switch connected to the traffic control system by wires.

8. The traffic control system of claim 6, wherein the traffic control device is a switch connected to a wireless transmitter, the wireless transmitter sends a wireless signal to a wireless receiver and the wireless receiver is operatively connected to the traffic control system for cycling the plurality of traffic lights.

9. The traffic control system of claim 8, wherein said operation of the traffic control device resets the watchdog timer upon receipt of the wireless signal.

10. The traffic control system of claim 8, wherein said operation of the traffic control device resets the watchdog timer upon receipt of the wireless signal only if the watchdog timer has not expired.

11. The traffic control system of claim 6, wherein the watchdog timer is implemented in a timer circuit that is operatively coupled to the traffic control system.

12. The traffic control system of claim 6, wherein the watchdog timer is implemented as firmware within the traffic control system.

13. A traffic control system comprising:

an enclosure for containing the traffic control system;

an access door on the enclosure;

a lock controlling access to the enclosure through the access door;

an automatic mode of operation and a manual mode of operation, whereas the traffic control system automatically cycles a state of a plurality of traffic lights when in the automatic mode of operation and cycles the state of the plurality of traffic lights in response to a change signal when in the manual mode of operation;

a means for activating the manual mode, means for activating the manual mode housed within the enclosure behind the access door;

a watchdog timer, the watchdog timer reset when the automatic mode activation switch is operated; the watchdog timer is also reset in response to the change signal;

a wireless transmitter, the wireless transmitter transmitting a wireless change signal responsive to activation of a control on the wireless transmitter; and a wireless receiver operatively coupled to the traffic control system, the wireless receiver configured to receive the wireless change signal and responsive to the wireless change signal, sending the change signal to the traffic control system and resetting the watchdog timer;

whereas upon expiration of the watchdog timer, the traffic control system switches to the automatic mode of operation.

14. The traffic control system of claim 13, wherein the control on the wireless transmitter is a push button switch.

15. The traffic control system of claim 13, wherein the wireless receiver resets the watchdog timer upon receipt of the wireless signal only if the watchdog timer has not expired.

* * * * *